US006293069B1

(12) United States Patent
Monda et al.

(10) Patent No.: US 6,293,069 B1
(45) Date of Patent: Sep. 25, 2001

(54) JOINT CLOSURE SYSTEM FOR FOAMBOARDS

(75) Inventors: Perry F. Monda; Leon F. Barry, both of St. Petersburg; Joseph R. Hagan, Belleair, all of FL (US); William J. Cole, Berlin, NJ (US)

(73) Assignee: Celotex Corporation, St. Petersburg, FL (US)

( * ) Notice: Subject to any disclaimer, the term of this patent is extended or adjusted under 35 U.S.C. 154(b) by 0 days.

(21) Appl. No.: 09/546,326

(22) Filed: Apr. 7, 2000

(51) Int. Cl.[7] ..... E04B 1/38; E04C 2/10

(52) U.S. Cl. ..... 52/460; 52/309.1; 52/469; 428/58; 428/316.6

(58) Field of Search ..... 52/309.5, 411, 52/459, 460, 469, 309.9, 309.1; 156/71; 428/53, 57, 58, 316.6

(56) References Cited

U.S. PATENT DOCUMENTS

| | | | | |
|---|---|---|---|---|
| D. 236,716 | | 9/1975 | Patterson et al. | D13/6 |
| D. 236,717 | | 9/1975 | Patterson et al. | D13/6 |
| D. 236,718 | | 9/1975 | Patterson et al. | D13/6 |
| 1,723,307 | | 8/1929 | Sipe . | |
| 2,974,078 | | 3/1961 | Petritz et al. | 154/43 |
| 3,439,406 | | 4/1969 | Wallin | 29/450 |
| 3,759,005 | | 9/1973 | Smith | 52/403 |
| 4,063,395 | * | 12/1977 | Stewart et al. | 52/309.5 |
| 4,099,355 | | 7/1978 | Strunk | 52/404 |
| 4,342,181 | | 8/1982 | Truesdell | 52/743 |
| 4,356,676 | | 11/1982 | Hauptman | 52/403 |
| 4,368,604 | * | 1/1983 | Spielau et al. | 428/316.6 |
| 4,848,044 | | 7/1989 | LaRoche et al. | 52/58 |
| 4,922,676 | | 5/1990 | Spronken | 52/396 |
| 5,251,416 | * | 10/1993 | White | 52/459 |
| 5,277,515 | | 1/1994 | Hovis et al. | 404/74 |
| 5,335,466 | | 8/1994 | Langohr | 52/396.04 |
| 5,593,771 | * | 1/1997 | Lawless et al. | 156/71 |

FOREIGN PATENT DOCUMENTS

1201154 * 8/1970 (GB) .

* cited by examiner

*Primary Examiner*—Michael Safavi
(74) *Attorney, Agent, or Firm*—Charles W. Vanecek

(57) ABSTRACT

An insulating structure comprises a board of insulating material having two major surfaces, two side edges and top and bottom edges, and facing sheets on each of the major surfaces, and a generally rectangular closure strip having two equal and integral side portions. One side portion is bonded to one of the facing sheets and extends over said facing sheet from the top edge to the bottom edge and inwardly a short distance from one of the side edges of the board. The other side portion extends outwardly away from the board a short distance from said side edge. A plurality of the insulating structures are positioned in abutting relationship to form an insulating envelope covering a wall or roof of a building.

18 Claims, 4 Drawing Sheets

JOINT CLOSURE SYSTEM FOR FOAMBOARDS

BACKGROUND OF THE INVENTION

1. Field of the Invention

This invention relates to a closure system to seal the joints between the abutting side edges of insulating foam panels used in wall and roof construction, especially in metal buildings.

2. Description of the Prior Art

Prefabricated foam panels are widely used to form an insulating envelope for insulating building walls and roofs. The overall insulating efficiency of the array of foam panels of the wall or roof system is influenced by the nature of the closure and seal arrangement used at the junction of the panels.

Currently, there are a variety of joint closures, including tapes, PVC strips, caulks and other sealants. These closures are installed at the job site, where care must be taken to ensure proper performance. The PVC strips are recommended, but they are relatively expensive and accordingly are replaced frequently by the less expensive tapes or sealants. Unfortunately, application of the latter closures is time consuming and difficult.

Furthermore, besides their expensiveness, the PVC strips usually recommended have other serious shortcomings. Their dimensional stability is relatively poor. In service in metal buildings, the PVC strips tend to twist and deform due to roof top temperatures, creating uninsulated areas where condensation can form and drop from the ceiling. It is also necessary to have a separate PVC profile for each insulation board thickness. Additionally, the PVC profiles are only 10' long, requiring cutting the length to fit the span between wall girts and ceiling purlins, resulting in inefficient, expensive use. More often than not, the PVC profiles do not adequately match-up to the board thickness, resulting in either a very tight, stressed fit or a very loose fit. Also, a sealant that must be field applied is also required to permanently attach the PVC strip and prevent air infiltration through the strip and insulation board interface.

OBJECTS OF THE INVENTION

It is therefore an object of the present invention to provide an improved closure and seal for the joint between the abutting edges of foam panels used in building construction.

It is also an object of the present invention to provide a seal which can be applied easily and inexpensively to the abutting edges of foam panels.

It is another object of the present invention to provide a seal which can be applied to a prefabricated foam panel before its installation at a job site.

SUMMARY OF THE INVENTION

The foregoing and other objects of the invention have been achieved by a closure strip which is adapted for installation over the joint between the adjoining edges of insulating foam panels of a wall or roof assembly. The strip is suitably sized to cover the joint and the neighboring portion of each foam panel forming the joint. An adhesive is provided to bond the strip to the panels. Bonding is readily obtainable by means of a pressure sensitive adhesive placed on the backside of the strip. The strip may be made of a wide variety of materials, including plastics, metals, coated papers, paperboard, and combinations thereof. In a preferred embodiment, the strip comprises a flexible material. Suitable flexible materials include open and closed cell foams.

DESCRIPTION OF THE DRAWINGS

The invention will now be described with reference to the accompanying drawings in which.

DETAILED DESCRIPTION OF THE INVENTION

Figure 1:
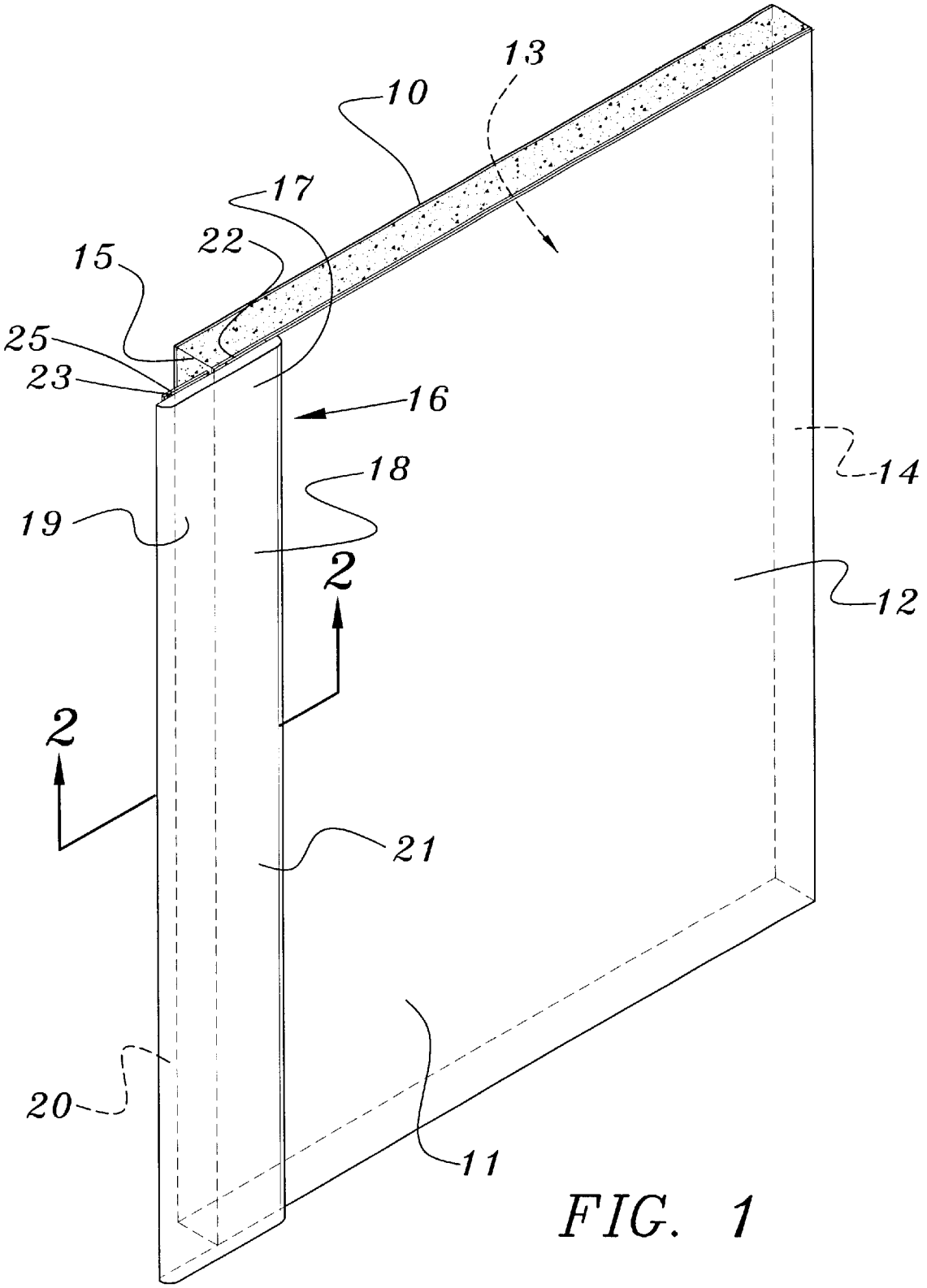
FIG. 1 is a perspective view of an insulating foam panel adhered to a joint closure strip of the invention.

Referring now to the drawings, the present invention is directed to a closure strip and to an improved insulation panel which is uniquely, simply and economically modified by the strip to provide an air infiltration barrier at an edge of the panel. A plurality of the panels are joined together to form an insulating envelope for a wall or roof structure of the invention.

Figure 2:
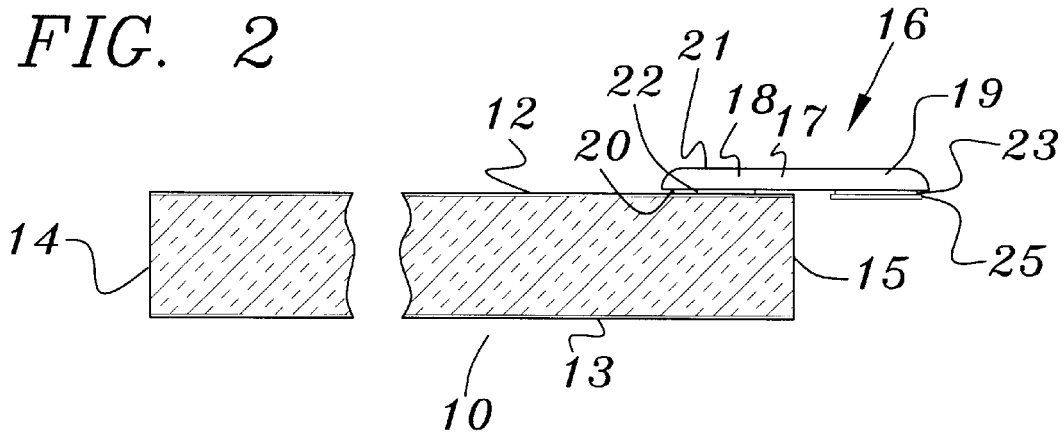
FIG. 2 is a fragmentary sectional detail view taken on line 2—2 of FIG. 1.

As shown in FIGS. 1 and 2, a structural panel constructed in accordance with the invention, designated 10, comprises a generally rectangular panel or board of insulating material 11 having two opposed major surfaces covered by facing sheets 12 and 13. Either or both of the major surfaces may also be uncovered. Panel 10 has a first side edge 14, a second side edge 15, and unreferenced top and bottom edges. The side of facing sheet 12 at edge 15 is covered by and bonded to a sealant and closure strip 16 of the invention. Strip 16 extends outwardly from panel 10 for coverage of the adjoining panel 10 upon installation of the panels in the wall or roof assembly.

The insulating material 11 which comprises the core of panel 10 may be any substance which retards or blocks heat transfer. In a preferred embodiment, the insulating material comprises a foamed plastic. Examples of such materials are polyurethane, polyisocyanurate, phenolic, rubber, polyvinyl chloride, urea-aldehyde, melamine-aldehyde, polystyrene, polypropylene, polyethylene, cellulosic acetate, epoxy, acrylonitrile-butadiene-styrene copolymer, silicone, and other polymeric foams.

The facers for covering the foam core may be composed of material which is flexible or rigid. A wide variety of materials are employable as the facers. Examples of the facers are a metal sheet such as steel or aluminum, plastic foils, a fiber glass sheet, an asphalt-saturated felt, an asphalt fiber glass sheet, paper, paperboard, oriented strand board, plywood, perlite board, gypsum board, fiberboard, etc. The facers may be made from combinations of these materials.

A preferred rigid thermal insulation panel 10 of the invention is a product made with a closed-cell polyurethane or polyisocyanurate foam core faced on both major surfaces. The facers are suitably adhered to the faces of the foam core during the process of foam manufacture. A suitable foam plastic thermal insulation panel is one made by Celotex Corporation of Tampa, Fla. under the designation Thermax®. Typical panel dimensions for use in the invention are 4 feet×10 feet 4 feet×20 feet although various other dimensions may also be used.

Figure 3:
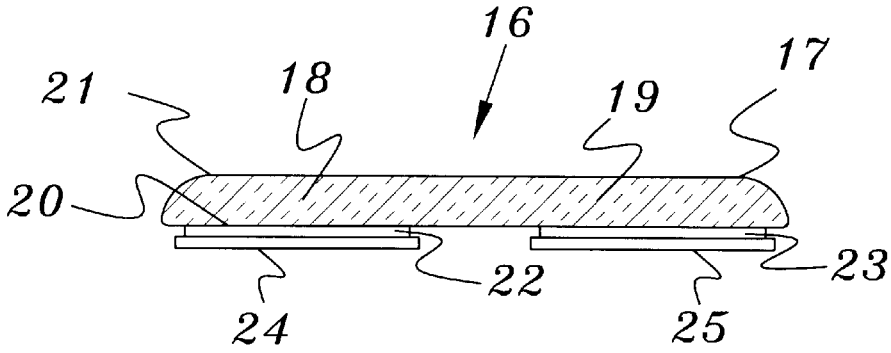
FIG. 3 is a cross-sectional view of the joint closure strip.
Figure 4:
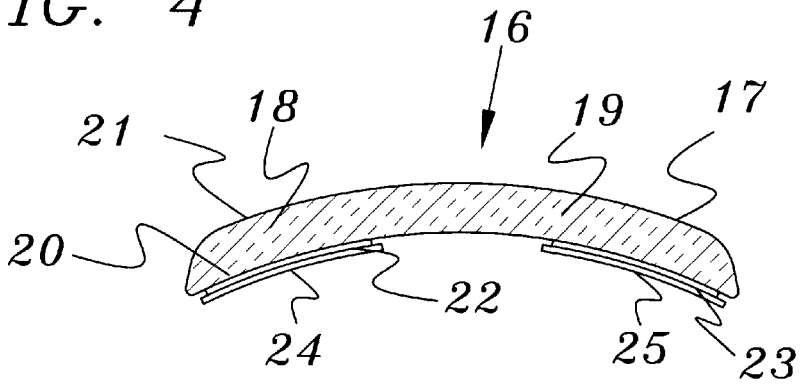
FIG. 4 is a cross-sectional view of another embodiment of the joint closure strip.

Closure strip 16 of the invention is designed to be applied over the joint between adjacent insulating panels 10 of a wall or roof assembly of the invention. A preferred embodiment of strip 16 comprises a plastic foam 17 with an adhesive thereon for attachment to the adjacent panels. Foam 17 may have open or closed cells or both. Polyolefin thermoplastics are preferred foam plastics. For example, one preferred foam is an extruded, closed cell polyethylene having a density of approximately 2 lbs/ft$^3$. The term "strip" is not intended to indicate any particular length but the length should be sufficient to correspond to the length of the joint being covered. The width of the strip is advantageously from about 1.5 to 4 inches. Strip 16 can be made with a wide range of profiles and thicknesses. The profile shown in FIG. 3 is generally flat, while that shown in FIG. 4 is curved. The curvature ensures good contact of each structural panel to the adjoining panel during installation onto the building frame to be insulated. A suitable thickness is from 3/16 to 1/4 inch.

As seen in FIGS. 1–4, closure strip 16 is divided into two equal and integral portions 18 and 19. The longitudinal centerline of strip 16, indicated by a dashed line, with portions 18 and 19 to each side thereof, lies over the edge 15 of panel 10. Portions 18 and 19 together have two major surfaces 20 and 21. Surface 20 faces inwardly toward insulating panel 10, and surface 21 faces to the exterior of the panel. Portion 18 extends downwardly from the top edge to the bottom edge and inwardly from the side edge 15 of panel 10 over a sufficiently large area for good bonding between strip 16 and panel 10. Portion 19 extends outwardly from portion 18 for similar coverage of and bonding to the adjoining panel in the final insulating assembly, as described hereinafter.

Thin strips 22 and 23 of a pressure sensitive adhesive are provided on surface 20 over side portions 18 and 19, respectively, to adhere each side portion of strip 16 to the respective adjoining panel 10. The adhesive, which is preferably in the form of a tape, includes any suitable material having sufficient bonding strength to adhere to and unite the panels 10 and strips 16. A pressure sensitive adhesive is preferred. While each of adhesive strips 22 and 23 may cover all or substantially all of the respective side portion of surface 20, it has been found satisfactory to cover from about 75 to 95% of each side portion. Thus, in the case of typical closure strips 16 having a width of 2 inches, the width of strips 22 and 23 may each suitably be about 3/4 inch, with the side edges of each adhesive strip preferably being located inwardly from the neighboring side edges of the respective covered side portion 18 or 19. Generally speaking, the pressure sensitive adhesive coating has a thickness of about 0.5 to 4.0 mils. As seen in FIGS. 3 and 4, adhesive layers 22 and 23 are covered by release films or tapes 24 and 25, respectively, to prevent sticking before attachment of closure strip 16 to the insulation panels. The release film is advantageously slightly wider than the adhesive strip to facilitate removal.

In a preferred method for constructing improved insulating panel 10, the basic panel is first prepared and then closure strip 16 is attached. In the case of a foam board, the initial production is desirably a continuous one and comprises conveying a lower facing material along a production line; applying a foam-forming mixture to the lower facing material; optionally supplying an upper facing material over the applied foam-forming mixture; and foaming and thermally curing the foam-forming mixture. Production may be accomplished as described in U.S. Pat. No. 4,764,420, the disclosure of which is hereby incorporated by reference.

Figure 5:
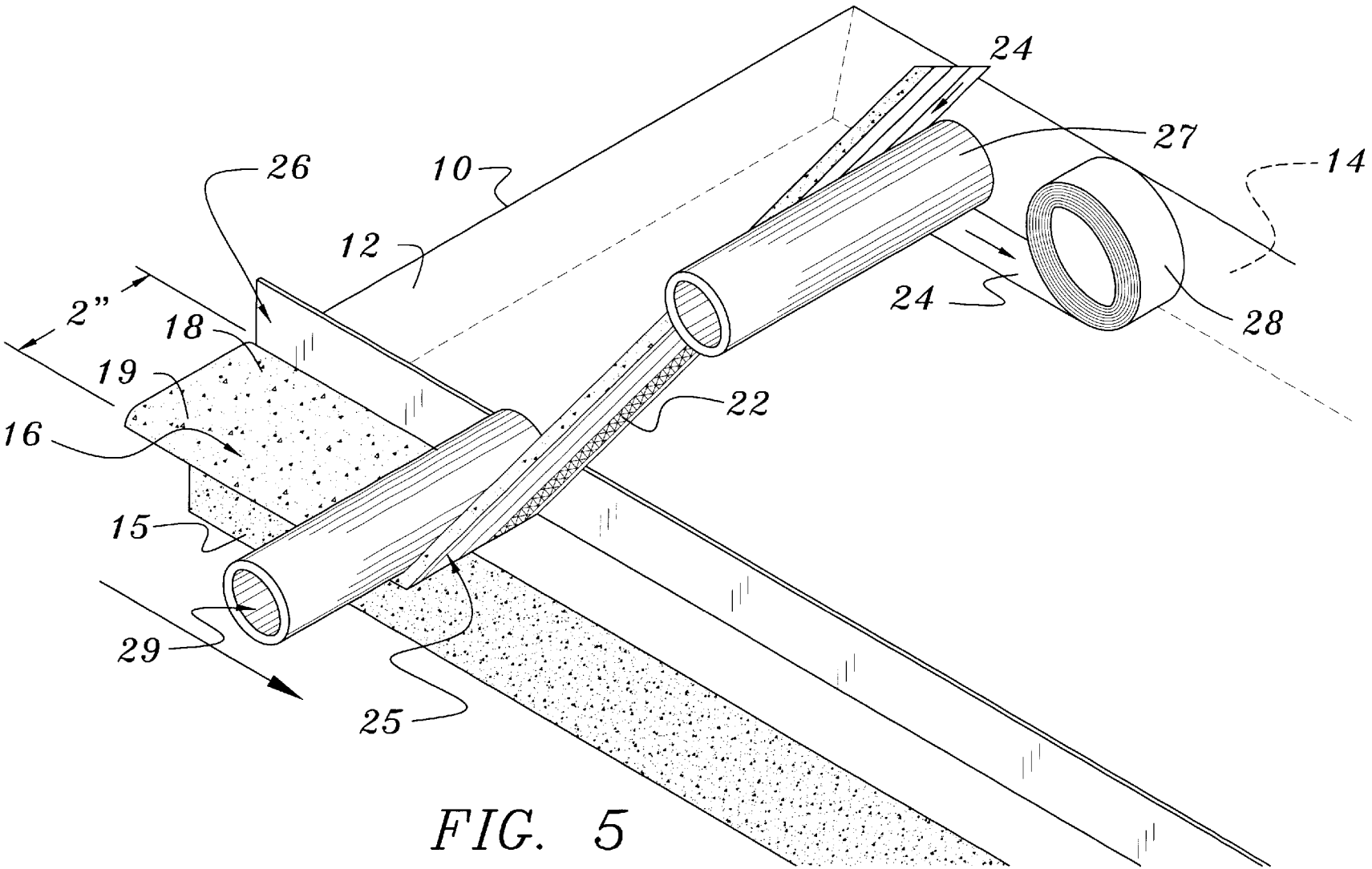
FIG. 5 is a schematic representation of a method for applying the joint closure strip to the insulating foam panel.

After production of the basic insulation panel, closure strip 16 is suitably applied along a side edge of the panel as shown in FIG. 5. Strip 16 is continuously unwound from a roller (not shown) in the direction of the arrow toward the insulation panel. A bar 26, vertically placed on facing sheet 12 of the panel, guides the placement of portion 18 of strip 16 over the side of the panel along edge 15. Release film 24 is stripped from strip 16 at cylinder 27, thereby exposing pressure sensitive adhesive 22 for bonding to facing sheet 12. Stripped film 24 is collected on a roll 28 and thereafter disposed of. A compression roll 29 pushes strip 16 down on the insulation panel to form a secure bond.

As a result of the application, while side portion 18 of closure strip 16 lies over panel 10, portion 19 projects away from the panel, with release film 25 left in place covering adhesive strip 23. Portion 19 is available in the final insulating assembly for coverage of and bonding to the area along the side edge 14 of the next adjacent panel 10, which likewise has a closure strip 16 along its side edge 15, and so forth throughout the final insulating assembly.

Figure 6:
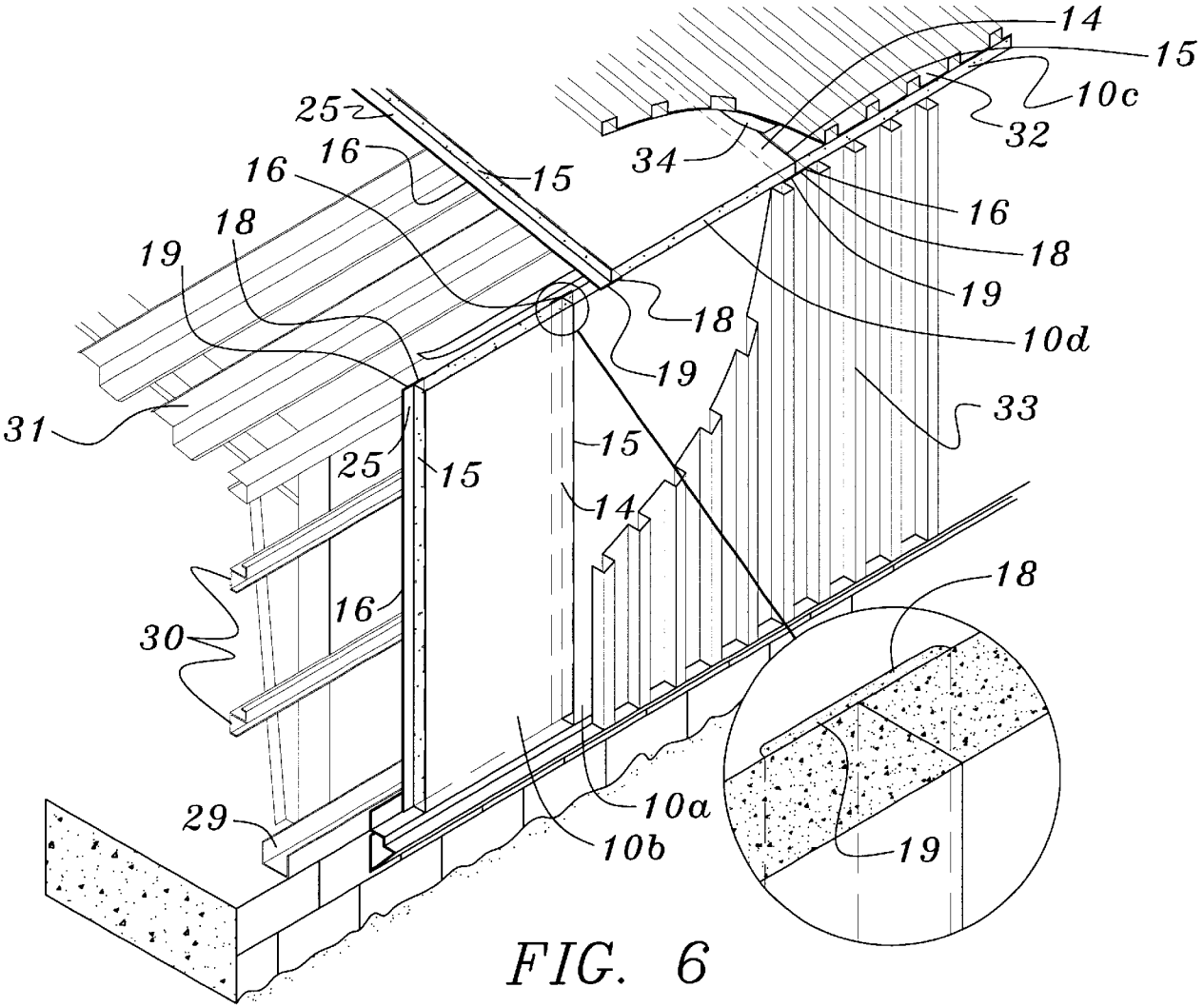
FIG. 6 is a partially cut-away sectional view illustrating the joint closure strips sealing joints between insulating foam panels of a metal building.

Referring to FIG. 6, the improved insulating panels 10 of the invention are shown in a partially insulated wall and roof of a metal building. The building includes a base tract 29 and a plurality of parallel spaced wall girts 30 and roof purlins 31. Conventional fasteners are used to attach the panels 10 to the supporting structures so that the closure strips 16 face to the interior of the building.

In the wall structure, panel 10*a* adjoins panel 10*b*, and, in the roof structure, panel 10*c* adjoins panel 10*d*. In the process of insulating the building structures shown in FIG. 6, panels 10*a* and 10*c* are installed before panels 10*b* and 10*d*, respectively. The closure strips 16 of panels 10*a* and 10*c* thus cover the joints with panels 10*b* and 10*d*, respectively.

Each of closure strips 16 of panels 10*b* and 10*d* has the side portion 19, which is covered by release film 25, available for attachment to an adjacent panel. Installation of a succeeding insulating panel 10 is accomplished by first peeling release film 25 from closure strip 16 of the already installed panel 10 and then placing the succeeding panel 10 adjacent the installed panel so that edge 14 of the succeeding panel abuts edge 15 of the installed panel. In the process, the area of facing sheet 12 along side edge 14 of the succeeding panel 10 is brought against and securely bonded to the strip 23 of pressure sensitive adhesive on closure strip 16 of the installed panel. When closure strip 16 is curved, as shown in FIG. 4, good contact between the strip 23 and facing sheet 12 is ensured during installation of the succeeding panel. Metal sheeting in the form of a standing seam metal roof 32 and metal siding 33 is installed on the outside of the roof and wall panels. A covering, such as aluminum tape 34, is suitably provided over the joints between the adjacent roof panels.

We claim:

1. An insulating assembly comprising a plurality of insulating structures lying in abutting relationship for forming an envelope to cover a wall or roof of a building, each structure comprising:

a generally rectangular board of insulating material having two major surfaces and a first facing sheet on one of the surfaces, and a second facing sheet on the other of the surfaces, first and second side edges, and top and bottom edges; and a generally rectangular closure strip having two equal and integral rectangular side portions comprising a first side portion extending over the first facing sheet from the top edge to the bottom edge and inwardly a short distance from the first side edge of the board, the first side portion being bonded to the first facing sheet, and a second side portion extending outwardly away from the board a short distance from the first side edge, the second side portion extending over the second side edge of the adjacent insulating structure and being bonded to the first facing sheet of the adjacent insulating structure wherein the insulating structures form an envelope to cover a wall or roof of a metal building, the first facing sheet of each insulating structure facing to the interior of the building, the second facing sheet of each insulating structure facing the exterior of the building, and each second facing sheet being covered by metal sheeting.

2. The insulating assembly of claim 1 wherein the insulating material comprises a foamed plastic.

3. The insulating assembly of claim 1 wherein the insulting material comprises a polyurethane or polyisocyanurate foam.

4. The insulating assembly of claim 1 wherein bonding of the first and second side portions of the closure strip to the respective first facing sheets is accomplished by means of pressure sensitive adhesive.

5. The insulating assembly of claim 4 wherein the closure strip comprises a flexible plastic foam.

6. The insulating assembly of claim 5 wherein the closure strip has a width of about 1.5 to 4 inches.

7. The insulating assembly of claim 1 wherein the first and second facing sheets are each aluminum foil.

8. The insulating assembly of claim 1 wherein the insulating material comprises a polyurethane or polyisocyanurate foam.

9. The insulating assembly of claim 8 wherein bonding of the first and second side portions of the closure strip to the respective first facing sheets is accomplished by means of pressure sensitive adhesive.

10. The insulating assembly of claim 9 wherein the closure strip comprises a flexible plastic foam.

11. The insulating assembly of claim 10 wherein the closure strip has a width of about 1.5 to 4 inches.

12. An insulating structure adapted to be positioned adjacent similar structures in edge-to-edge relationship to cover a wall or roof of a building, the structure comprising:

a generally rectangular board of insulating material having two major surfaces and a first facing sheet on one of the surfaces, and a second facing sheet on the other of the surfaces, first and second side edges, and top and bottom edges; and a generally rectangular closure strip having two equal and integral rectangular side portions comprising a first side portion extending over the first facing sheet from the top edge to the bottom edge and inwardly a short distance from the first side edge of the board, the first side portion being bonded to the first facing sheet, and a second side portion extending outwardly away from the board a short distance from the first side edge, the surface of the second side portion which extends outwardly from the bonded surface of the first side portion being covered by a strip of a pressure sensitive adhesive, the pressure sensitive adhesive being covered by a release tape.

13. The insulating structure of claim 12 wherein the insulating material comprises a foamed plastic.

14. The insulating structure of claim 12 wherein the insulating material comprises a polyurethane or polyisocyanurate foam.

15. The insulating structure of claim 12 wherein the first side portion of the closure strip is bonded to the first facing sheet by means of a strip of a pressure sensitive adhesive.

16. The insulating structure of claim 13 wherein the closure strip comprises a flexible plastic foam.

17. The insulating structure of claim 16 wherein the closure strip has a width of about 1.5 to 4 inches.

18. The insulating structure of claim 16 wherein the closure strip has a width of about 2 inches and said strip of pressure sensitive adhesive has a width of about ¾ inch.

* * * * *